United States Patent [19]

Sumigawa

[11] Patent Number: 4,709,671

[45] Date of Patent: Dec. 1, 1987

[54] OUTBOARD MOTOR PROVIDED WITH A FOUR-STROKE ENGINE

[75] Inventor: Yukio Sumigawa, Iwata, Japan

[73] Assignee: Sanshin Kogyo Kabushiki Kaisha, Hamamatsu, Japan

[21] Appl. No.: 860,848

[22] Filed: May 8, 1986

Related U.S. Application Data

[62] Division of Ser. No. 650,291, Sep. 12, 1984, Pat. No. 4,611,559.

[30] Foreign Application Priority Data

Sep. 13, 1983 [JP] Japan ..... 58-167425
Sep. 13, 1983 [JP] Japan ..... 58-167426

[51] Int. Cl.[4] ..... F01M 1/00
[52] U.S. Cl. ..... 123/196 S; 123/196 W
[58] Field of Search ..... 123/196 W, 196 S

[56] References Cited

U.S. PATENT DOCUMENTS 1,203,290 10/1916 Weiland ..... 123/196 R
2,182,948 12/1939 Schjolin ..... 123/196 R
4,452,194 6/1984 Watanabe ..... 123/196 W

*Primary Examiner*—William A. Cuchlinski, Jr.
*Attorney, Agent, or Firm*—Ernest A. Beutler

[57] ABSTRACT

Several embodiments of outboard motors embodying four-cycle engines and improved lubricating systems therefor. In all of the embodiments, an oil reservoir is provided in the drive shaft housing and a combined screen and drain plug assembly filters the oil flowing from the oil reservoir to the engine lubricating system and for facilitating servicing of the screen by removal of the drain plug. In one embodiment, the oil reservoir is formed integrally with the drive shaft housing. A pressure relief valve depends into the oil reservoir and is carried by a plate that connects the engine to the drive shaft housing for facilitating servicing and reducing the likelihood of leakage back of oil to the engine when the outboard motor is tilted up. An improved relief valve screen assembly is also illustrated in one embodiment where in the screen may be bypassed if it becomes clogged.

6 Claims, 7 Drawing Figures

OUTBOARD MOTOR PROVIDED WITH A FOUR-STROKE ENGINE

This is a division of U.S. patent application Ser. No. 650,291, filed Sept. 12, 1984, now U.S. Pat. No. 4,611,559.

BACKGROUND OF THE INVENTION

This invention relates to an outboard motor provided with a four-stroke engine and more particularly to an improved lubricating system for an internal combustion engine.

With engines embodying separating lubricating systems having separate oil reservoirs, such as are commonly employed with four-stroke engines, it is the practice to use a filtering screen on the oil pickup element that extends into the oil reservoir. The use of such screens is to remove foreign particles from the lubricant before it is delivered to the lubricating system of the engine. However, when such a lubricating screen is employed in conventional lubricating systems, it is necessary to remove the oil reservoir from the engine to afford access to the screen for its servicing and/or replacement.

The aforenoted problem is particularly acute if the engine is utilized in conjunction with an outboard motor. Outboard motors, due to their compact nature, make it very difficult to locate a suitably sized oil reservoir. Although it has been proposed to position the oil reservoir in the drive shaft housing portion of the engine and thus lower the center of gravity, this can complicate the problem in connection with servicing of a strainer in the oil reservoir.

It is, therefore, a principal object of this invention to provide an improved lubricating system for an internal combustion engine.

It is another object of this invention to provide a lubricating system for an internal combustion engine wherein the lubricant strainer may be serviced without necessitating removal of the lubricant sump from the engine.

It is a still further object of this invention to provide an improved lubricating system for the four-stroke cycle engine of an outboard motor that facilitates servicing.

As has been noted, when employing four-cycle engines in outboard motors, it is difficult to provide an adequate oil reservoir within the confined space. Previously proposed outboard motors using four-cycle engines have positioned the crankcase in the power head which thus substantially increases the height and raises the center of gravity of the outboard motor. Obviously, both of these results are undesirable. It has been proposed, as has been noted, to provide a separate oil reservoir that is located within the drive shaft housing. However, although this solves the aforenoted problems, it can present some problems of its own. For example, it is the normal practice to provide an external drain for the oil from the reservoir so that it can be replenished without having to disassemble the engine. However, the use of such external drains have presented the problem of sealing between the oil reservoir and the extenal drain of the drive shaft housing. In addition, the use of separate elements for this purpose complicates the overall structure. Such such separate oil reservoirs contained within the drive shaft housing can render some problems when servicing the engine and when considering vibration isolation.

It is, therefore, a still further object of this invention to provide an improved and simplified oil reservoir system for an outboard motor.

It is another object of this invention to provide an improved oil reservoir for an outboard motor that is formed integrally with the drive shaft housing.

Another problem attendant with the use of drive shaft housing positioned oil reservoirs for four-cycle engines is the arrangement for returning oil to the reservoir from a bypass valve. Normally, lubricating systems for engines include a pressure relief or bypass valve that returns oil to the oil reservoir when the pressure in the lubricating system exceeds a predetermined desired pressure. Where the oil reservoir is positioned within the drive shaft housing, this means that the pressure relief valve, which is normally positioned in the engine, must be provided with a drain that will permit oil to flow from the pressure relief valve back to the oil reservoir. However, the oil can return to the engine through such openings when the engine is tilted up and this is very undesirable.

It is, therefore, a still further object of this invention to provide an improved oil sump arrangement including a pressure return valve for an outboard motor.

It is another object of this invention to provide an oil relief system for an outboard motor wherein the relief valve is positioned remotely from the engine to facilitate servicing.

SUMMARY OF THE INVENTION

A first feature of this invention is adpated to be embodied in a lubricating system for an internal combustion engine having a lubricant reservoir adapted to contain a lubricant for the engine, an inlet line depending into the lubricant reservoir for supplying lubricant for the engine lubricating system, a strainer disposed at the inlet end of the inlet line for removing foreign particles from the lubricant entering the inlet line, a drain opening in the lubricant reservoir for draining lubricant therefrom, and a drain plug for closing the drain opening. In accordance with this feature of the invention, the drain opening and the strainer are sized and related for servicing of the strainer through the drain opening.

Another feature of this invention is adapted to be embodied in an outboard motor having a power head containing an internal combustion engine, a drive shaft housing depending from the power head and a lower unit depending from the drive shaft housing. In accordance with this feature of the invention, an oil reservoir is formed integrally with the drive shaft housing for supplying lubricant to the engine.

Yet another feature of the invention is also adapted to be embodied in an outboard motor having a power head containing an internal combustion engine, a drive shaft housing depending from the power head, a lower unit depending from the drive shaft housing and an oil reservoir for the engine contained within the drive shaft housing. In accordance with this feature of the invention, the engine lubricating system includes a pressure relief valve that depends into the oil reservoir for recirculating oil from the engine lubricating system back to the oil reservoir when the pressure exceeds a predetermined value.

DETAILED DESCRIPTION OF THE PREFERRED EMBODIMENTS

Figure 1:
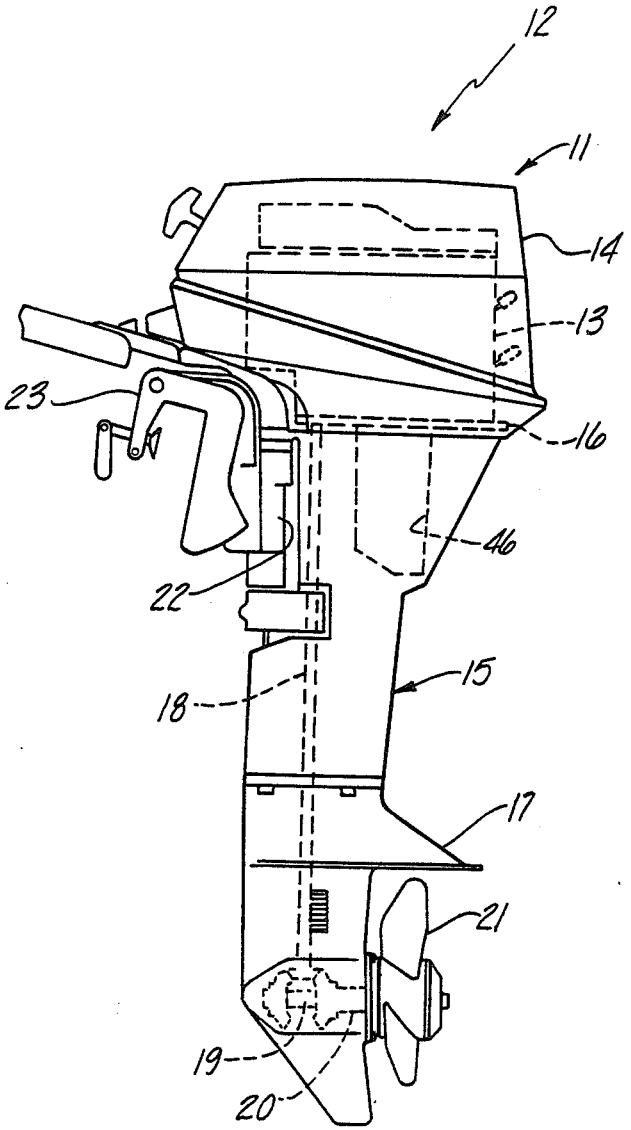
FIG. 1 is a side elevational view of an outboard motor constructed with an embodiment of the invention.

Referring first to FIG. 1, an outboard motor constructed in accordance with a first embodiment of the invention is identified generally by the reference numeral 11. The outboard motor 11 includes a power head, indicated generally by the reference numeral 12, containing an internal combustion engine 13 and surrounded by a protective cowling 14. The power head 12 is connected to the upper end of a drive shaft housing 15 by means including a spacer plate 16. At the lower end of the drive shaft housing 15, there is formed a lower unit 17. A drive shaft 18 depends from the power head 12, through the drive shaft housing 15 and terminates in the lower unit 17. The drive shaft 18 drives a forward, neutral, reverse transmission 19 that is operative in a known manner so as to drive a propeller shaft 20 and propeller 21 that is journalled in the lower unit 17. The outboard motor 11 and, specifically the drive shaft housing 15, is supported for steering movement about a vertically extending axis, in a known manner, by means including a swivel bracket 22. The swivel bracket 22 is, in turn, pivotally connected to a clamping bracket 23 for movement about a horizontally extending tilt axis. The clamping bracket 23 is adapted to be affixed to a transom of an associated watercraft (not shown) in a known manner. The construction of the motor 11 as thus far described may be considered to be conventional.

Figure 2:
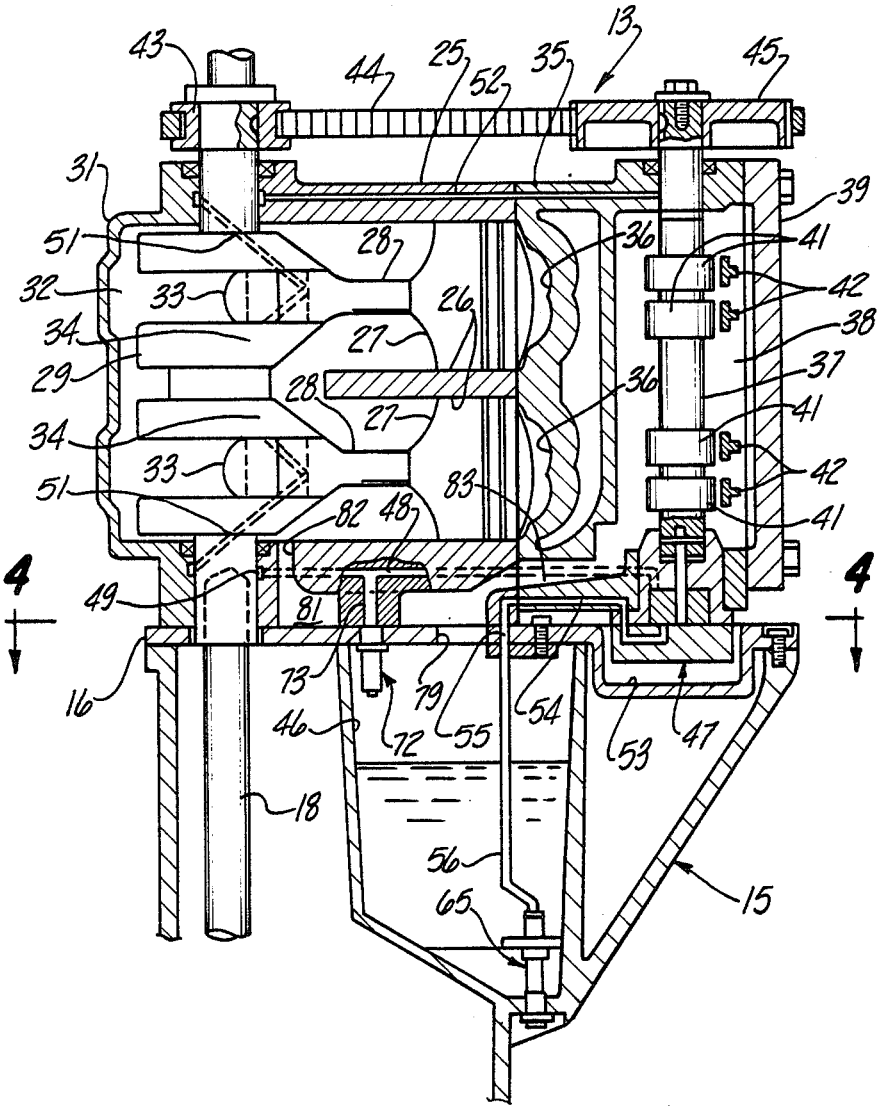
FIG. 2 is an enlarged cross-sectional view taken through a portion of the power head and upper portion of the drive shaft housing showing the engine and its lubricating system in accordance with this embodiment of the invention.

Referring now additionally to FIG. 2, the engine 13 is, in accordance with the invention, of the four-cycle type. The engine 13 includes a cylinder block 25 in which a pair of vertically disposed cylinder bores 26 are formed. In the illustrated embodiments, the engine 13 is of the two-cylinder in-line type. It is to be understood, however, that the invention may be utilized in conjunction with engines of other cylinder numbers, other cylinder dispositions, such as V-type engines, or with engines operating on the four-stroke principle but of other types such as rotary engines.

Pistons 27 are supported for reciprocation within the cylinder bores 26 and are connected by means of connecting rods 28 to a crankshaft 29 which is supported for rotation about a vertically extending axis. The rotational support for the crankshaft 29 is provided between the cylinder block 25 and a crankcase 31 that is affixed to the cylinder block 25 and which defines a crank chamber 32 in which the crankshaft 29 rotates. The connecting rod lower ends 33 are journalled on throws 34 of the crankshaft 29 in a known manner.

A cylinder head 35 is affixed to the cylinder block 25 at the side opposite the crankcase 31 in a known manner. The cylinder head 35 has recesses 36 that cooperate with the pistons 27 and cylinders 26 so as to form the combustion chambers. One or more spark plugs (not shown) are supported by the cylinder head 35 and have their electrodes disposed within the combustion chambers 36 for firing the charge therein in a known manner.

A camshaft 37 is journalled for rotation about an axis parallel to the axis of rotation of the crankshaft 29 within a cam chamber 38 formed at the upper end of the cylinder head 35. The cam chamber 38 is closed by a cover plate 39 which is, in turn, affixed to the cylinder head 35 in any suitable manner. The camshaft 37 is formed with pairs of lobes 41. The cam lobes 41 are associated with each cylinder 26 and operate intake and exhaust valves (not shown) in any suitable manner as via rocker arms 42 so as to admit a charge to the chambers 36 and so as to exhaust the burnt charge from these chambers.

A pulley or sprocket 43 is affixed to the upper end of the crankshaft 29 and drives a toothed belt 44 which, in turn, drives a driven pulley or sprocket 45 that is affixed to the upper end of the camshaft 37 so as to drive the camshaft 37 in timed relationship to the crankshaft 29. As is well known with the four-cycle type of engine, the camshaft 37 is driven at one-half crankshaft speed.

The engine 13 is affixed in a suitable manner to the upper side of the spacer plate 16, as by bolts and nuts or by studs and nuts. The engine 13 includes a lubricating system including an oil sump, indicated generally by the reference numeral 46 that is affixed to the lower side of the spacer plate 16 and which, in accordance with this embodiment of the invention, is formed integrally with the upper end of the drive shaft housing 15. Because the oil sump 46 is positioned within the drive shaft housing 15, it is possible to mount the engine 13 lower than if the sump were positioned above the spacer plate 16 and thus a relatively compact, low center of gravity motor 11 is provided. In addition, this location of the oil sump 46 permits it to be of a larger capacity than if it were contained within the power head 12. The oil sump 46 is fixed to the spacer plate 16 in such a manner that the engine 13 may be removed from the spacer plate 16 for servicing without removal of the oil sump 46.

In addition to the oil sump 46, the lubricating system includes an oil pump, indicated generally by the reference numeral 47, which includes an impeller or pumping element that is driven off the lower end of the camshaft 37. Pressurized oil is delivered from the oil pump 47 through an oil delivery passage 48 that extends through the cylinder head 35, cylinder block 25 and which terminates at an end 49 in communication with the crankshaft lower bearing. The crankshaft is cross drilled, as at 51 so as to deliver oil to the connecting rod journals and also to an upper bearing of the crankshaft between the cylinder block 25 and crankcase 31. The upper crankshaft cross drilling communicates with a further oil delivery passage 52 that extends through the cylinder block 25 and cylinder head 35 so as to lubricate the upper journal of the camshaft 37. Oil may flow downwardly from this journal to lubricate the cam lobes 41, and remaining components of the valve train.

Adjacent the lower end of the oil pump 47, the plate 16 is provided with a recess 53 so as to clear the nose piece of the oil pump 47. An oil inlet passage 54 extends through this nose piece, the cylinder head 35 and the cylinder block 25 and terminates in an inlet passage 55 that is formed in the spacer plate 16. An oil intake pipe 56 has its upper, discharge end surrounded by a seal 57 that is carried by a plate 58. The plate 58 is affixed to the underside of the spacer plate 16 by means of a bolt 59 with the seal 57 providing a seal around the plate opening 55 so as to place the inlet pipe 56 in sealed communication with the opening 55.

The inlet pipe 56 depends into the oil sump 46 and has its lower inlet end sealingly engaged by a seal 61 that is carried by a wall member 62 that is positioned at the lower end of the oil sump 46 and which may be fixed in any suitable manner to the drive shaft housing 15. An inlet passageway 63 extends through the wall 62 so as to permit oil to flow into the inlet end of the intake pipe 56.

The opening 63 is disposed immediately above a drain opening 64 that is formed in the drive shaft housing 15 adjacent the lower end of the oil sump 46 and at its lowest point. The drain opening 64 is provided so as to permit the draining of lubricant from within the lubricant sump 46 when the engine is still in place and without necessitating removal of the sump 46 from within the drive shaft housing 15. That is, the drain opening 64 is accessible externally of the drive shaft housing 15.

A combined drain plug and inlet screen assembly, indicated generally by the reference numeral 65 is provided for serving the combined functions of closing the drain opening 64 and for filtering the oil that is drawn from the sump 46 before it enters the inlet pipe 56. This assembly 65 includes a drain plug portion 66 that has a threaded periphery which engages threads formed around the drain opening 64 so as to detachably connect the screen and drain plug assembly 65 in the opening 64. In addition, the plug 66 is formed with a cylindrial recess 67 in which the lower end of a filtering screen 68 is received and affixed. The upper end of the screen 68 is received in a similar groove of a supporting member 69. The supporting member 69 is adapted to fit into a counterbore 71 positioned adjacent the lower end of the bore 63 and carries an O-ring seal so that when the assembly 65 is in place, the supporting plug 69 will be sealingly engaged in the counterbore 71.

It should be readily apparent from the foregoing description, that oil must flow radially inwardly through the screen 68 before it can enter the inlet pipe 56. Thus, large foreign particles will be removed from the oil before it enters the lubricating system. Furthermore, the screen 68 may be readily inspected, cleaned and replaced when the plug and screen assembly 65 is removed since the screen 68 and supporting plug 69 are sized so as to pass through the drain opening 64 each time the oil is drained.

As is common with most lubricating systems for pressure lubricated engines, a pressure relief valve is provided in the output line of the oil pump 47 so as to limit the maximum pressure in the lubrication system. Normally, these pressure relief valves are carried directly by the engine 13 and, therefore, when a remotely positioned lubricant sump is provided, it is necessary to provide a drain passage for returning the relieved lubricant from the pressure relief valve to the lubricant sump. These openings permit oil to flow back to the engine when the outboard motor 11 is tilted up and this is undesirable. In addition, the pressure relief valves in the prior art contructions have been exposed from the engine lower surface and thus it has been impossible to stand the engine on its lower surface without removing this pressure relief valve.

In accordance with the invention, an arrangement is provided wherein a pressure relief valve, indicated generally by the reference numeral 72, is carried not by the engine but is supported by the lower face of the spacer plate 16 immediately above the oil sump 46. This relief valve 72 communicates with a passageway 73 that extends from the lower face of the cylinder block 25 adjacent the spacer plate 16 upwardly to intersect the cylinder block oil delivery passageway 48. Hence, oil pump output pressure will be exerted in the passageway 73 on the relief valve 72.

Figure 3:
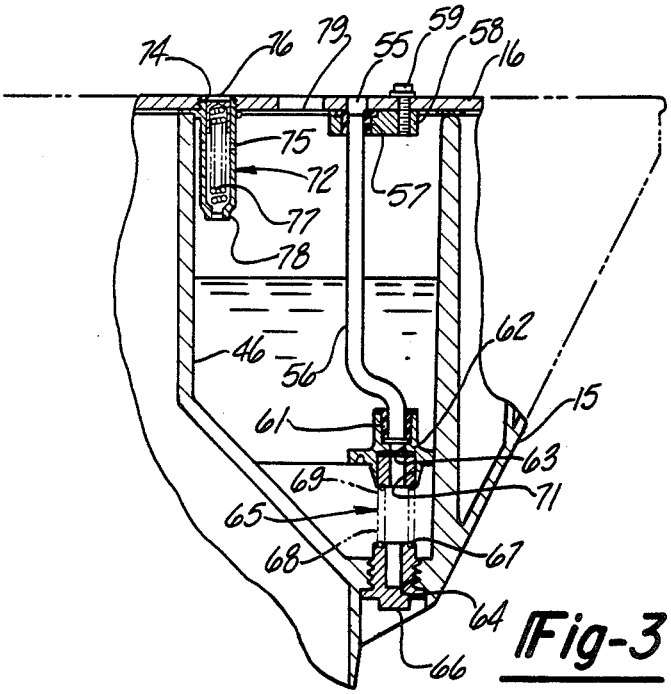
FIG. 3 is a further enlarged cross-sectional view of the embodiments shown in FIGS. 1 and 2 and specifically of the oil reservoir.

Referring specifically to FIG. 3, it will be noted that the the spacer plate 16 is formed with an opening 74 in which a housing member 75 of the relief valve 72 is affixed in a suitable manner. The housing 75 supports a valving element 76 that is urged by a coil compression spring 77 to a closed position with a sufficient pressure so as to determine the pressure in the lubricating system. When this pressure is exceeded, the valve element 76 may move downwardly compressing the spring 77 and permit oil to be relieved back to the sump through a discharge opening 78 so as to limit the maximum pressure in the system. Thus, it should be readily apparent that removal of the engine 13 from the plate 16 permits the engine to be stood on its lower face for servicing. In addition, the relief valve 72 may then be removed from service by removal of the spacer plate 16. Furthermore, since the passage 74 is closed by the relief valve 72, oil cannot flow back to the engine through the passage 73 when the engine is tilted up.

The lubricant which is circulates to the engine is returned to the sump 46 through a return opening 79 that is formed in the spacer plate 16. Preferably, the opening 79 is configured and positioned so that oil cannot flow back through it to the engine 13 when the outboard motor 11 is tilted up. A drain cavity 81 is formed in the lower face of the cylinder block 25 and communicates with the drain opening 79. Oil may flow to the drain cavity 81 from the crankcase chamber 32 through a crankcase drain 82. In a like manner, oil may flow to the drain cavity 81 from the camshaft chamber 38 through a drain passage 83 formed in the cylinder head 35 and cylinder block 25. Hence, a very effective lubricating system is provided.

Figure 4:
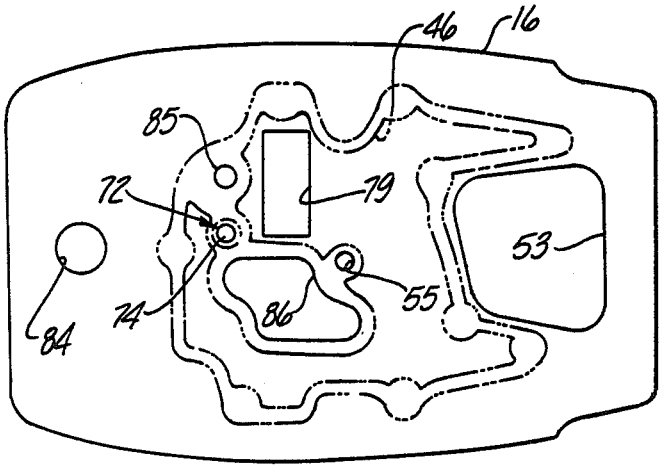
FIG. 4 is a cross-sectional view taken along the line 4—4 of FIG. 2.

Referring now to FIG. 4, in addition to the oil pump recess 53, the oil inlet opening 55, the oil return opening 79 and the relief valve opening 74, the spacer plate 16 is provided with an opening 84 to clear and pass the drive shaft 18 and an opening 85 so as to permit water to be passed upwardly through the drive shaft housing 15 to the engine cooling system in a known manner. In addition, an exhaust gas opening 86 extends through the plate 16 so as to permit exhaust gases to be delivered downwardly through the plate 16 in a known manner to discharge through an underwater exhaust with silencing within the drive shaft housing 15.

Figure 5:
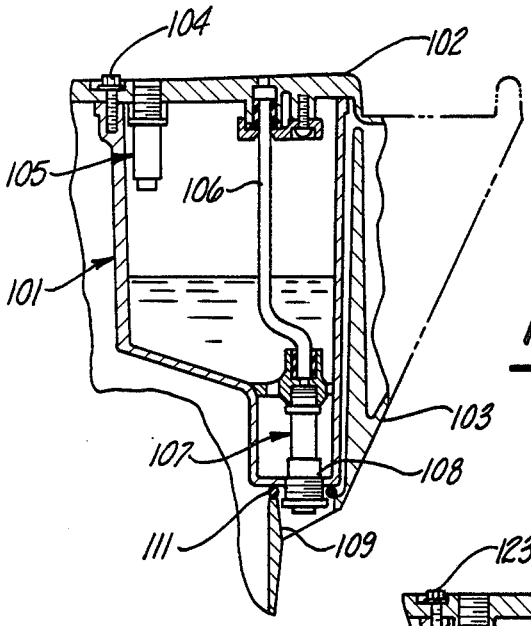
FIG. 5 is a cross-sectional view, in part similar to FIG. 3, showing another embodiment of the invention.

In the embodiment of the invention previously described, the oil sump 46 is formed integrally within the drive shaft housing 15. It is to be understood that the invention may also be used in conjunction with arrangements wherein the oil sump is provided by a separate member within the drive shaft housing and FIG. 5 illustrates such an embodiment. In this embodiment, the main portion of the engine and its lubricating system is the same as the previously described embodiment and for that reason only the oil sump, indicated generally by the reference numeral 101, and its relationship with the spacer plate 102 is illustrated and will be described. The spacer plate 102 is affixed to a drive shaft housing 103 in a manner as previously described and the upper end of the oil sump 101 is affixed to the spacer plate 102, as by means of fasteners 104. As with the previously described embodiment, a relief valve, indicated generally by the reference numeral 105, is affixed to the underside of the spacer plate 102 and depends into the upper end of the oil sump 101.

An oil inlet pipe 106 is affixed to the lower side of the spacer plate 102 in the manner of the previously described embodiment and has its lower end communicating with a combined strainer and drain plug assembly, indicated generally by the reference numeral 107, and which may have the construction as in the previously described embodiment. In this embodiment, the oil sump 101 has a drain opening 108 in which the plug and screen assembly 107 is received. The drive shaft housing 103 has a mating opening 109 that affords access to the drain plug and screen assembly 107. An O-ring seal 111 seals the area between the oil sump drain opening 108 and the corresponding drive shaft housing opening 109 so as to prevent the leakage of oil back into the drive shaft housing when it is being drained.

Figure 6:
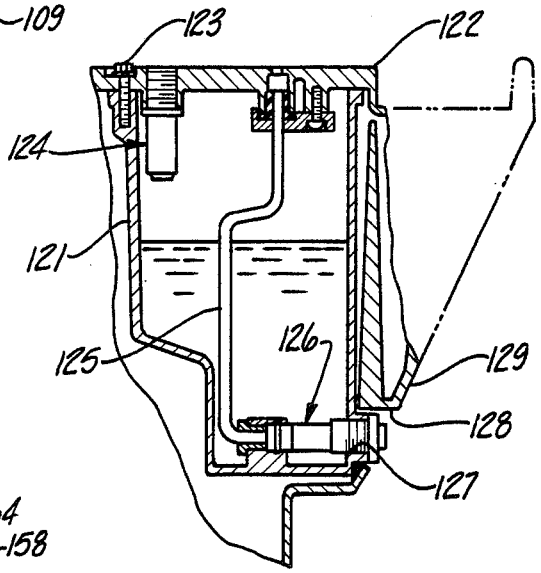
FIG. 6 is a cross-sectional view, in part similar to FIGS. 3 and 5, showing a still further embodiment of the invention.

FIG. 6 shows a somewhat different embodiment wherein an oil sump 121 is affixed to an underside of a spacer plate 122 as by means of fasteners 123. As in the previously described embodiments, a pressure relief valve 124 is affixed to the underside of the spacer plate 122 and communicates with the interior of the oil sump 121.

In this embodiment, an inlet pipe 125 is also affixed to the underside of the spacer plate 122 in the manner previously described and depends into the oil sump 121. The lower end of the inlet pipe 125 extends horizontally and cooperates with a horizontally disposed oil plug and screen assembly 126 which may have a construction of the type as in the previously described embodiments. In this embodiment, the oil sump 121 has a horizontally extending drain opening 127 that is closed by the plug assembly 126 and which cooperates with a suitable opening 128 in a drive shaft housing 129 so as to permit draining of the oil from the sump 121 and servicing of the screen and plug assembly 126.

Figure 7:
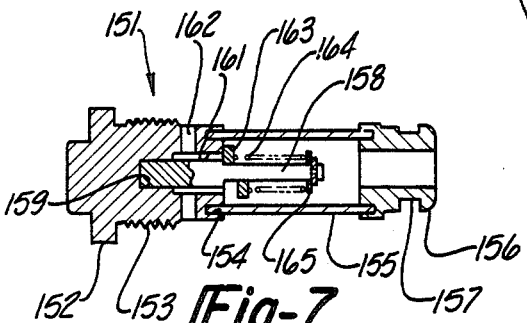
FIG. 7 is a cross-sectional view showing another embodiment of the invention.

In the embodiments thus far described, the screen and plug assembly may be readily serviced at any time that the oil is changed by a simple removal. However, if the screen becomes plugged before the oil is changed, the stoppage may reduce the flow of oil to the inlet line. In FIG. 7, there is indicated generally by the reference numeral 151, a combined screen and plug assembly that may be used with any of the previously described embodiments and which will prevent this dangerous condition.

Referring specifically to FIG. 7, the screen and plug assembly 151 includes a drain plug portion 152 having external threads 153 that are adapted to cooperate with the drain opening of the oil sump. The plug 152 is formed with a cylindrical recess 154 in which one end of a screen 155 is received. The opposite end of the screen 155 is received in a corresponding recess of a supporting plug 156. The supporting plug 156 is provided with a circumferential recess 157 to receive the O-ring seal that cooperates with the supporting plate in the oil sump that holds the inlet end of the inlet pipe. As thus far described, this drain plug screen assembly 151 may be considered the same as the plug 65 of the embodiment of FIGS. 1 through 4, the plug 107 of the embodiment of FIG. 5 and the plug and screen assembly 126 of the embodiment of FIG. 6.

In connection with this embodiment, a stem 158 is press fit at one of its ends into a bore 159 of the plug 152 and extends into the hollow interior of the screen 155. A counterbore 161 encircles the lower end of the stem 158 and communicates with a plurality of radially extending passageways 162 of the plug 152 which will open into the oil reservoir when the assembly 151 is in place. Hence, oil may flow through the passageways 162 into the counterbore 161 bypassing the screen 155.

The counterbore 161 is normally closed by means of a washer 163 that is urged by a coil compression spring 164 encircling the stem 158 to a closed position. The other end of the spring 164 is abuttingly engaged with a washer or snap ring 165 fixed to the inner end of the stem. As shown in the top portion of FIG. 7, the washer 163 normally closes the counterbore 161 and oil for the lubricating system must flow radially inwardly through the screen 155 before it can enter the inlet pipe. If, however, the screen 155 becomes plugged sufficiently, the suction pressure will cause the washer 163 to compress the spring 164 and open the counterbore 161 as shown in the lower side of this figure. Hence, oil may flow into the inlet line bypassing the screwen 155 under this condition.

It should be readily apparent from the foregoing description that a number of embodiments of the invention have been illustrated and described which provide improved lubricating systems for four-cycle engines, particularly those for use in conjunction with outboard motors. Although a number of embodiments of the invention have been illustrated and described, various changes and modifications may be made from those embodiments without departing from the spirit and scope of the invention, as defined by the appended claims.

I claim:

1. In an outboard motor having a power head containing an internal combustion engine, a drive shaft housing depending from said power head, said drive shaft housing having an outer wall enclosing a drive shaft driven by said engine and a lower unit depending from said drive shaft housing and containing propulsion means driven by said drive shaft, the improvement comprising an oil reservoir formed by upstanding walls formed integrally with said drive shaft housing outer wall for supplying lubricant to said engine.

2. In an outboard motor as set forth in claim 1 further including a spacer plate interposed between the power head and drive shaft housing, said internal combustion engine being affixed to the upper side of said spacer plate and said spacer plate having an oil return passage.

3. In an outboard motor as set forth in claim 2 further including relief valve means communicating with the pressure side of the engine lubricating system and affixed to the underside of said plate in communication with the oil reservoir.

4. In an outboard motor as set forth in claim 1 further including an oil inlet pipe extending into the oil reservoir and having a screen at its lower end, the drive shaft housing outer wall having a drain opening for draining lubricant therefrom and drain plug means for closing the drain opening, said screen and said drain opening being related for removal of said screen through said drain opening.

5. In an outboard motor as set forth in claim 4 further including a spacer plate interposed between the power head and drive shaft housing, said internal combustion engine being affixed to the upper side of said spacer plate and said spacer plate having an oil return passage extending therethroughfor returning oil from the engine to the oil reservoir.

6. In an outboard motor as set forth in claim 5 further including relief valve means communicating with the pressure side of the engine lubricating system and affixed to the underside of said plate in communication with the oil reservoir.

* * * * *